US012577693B2

(12) United States Patent
Lee et al.

(10) Patent No.: US 12,577,693 B2
(45) **Date of Patent: *Mar. 17, 2026**

(54) HIGH LUMINOUS SILVER NANOCLUSTERS DOPED WITH METAL HYDRIDE, MANUFACTURING METHOD THEREOF, AND ELECTROCHEMICAL CATALYST FOR HYDROGEN GAS GENERATION

(71) Applicant: Industry-Academic Cooperation Foundation, Yonsei University, Seoul (KR)

(72) Inventors: Dongil Lee, Goyang-si (KR); Hanseok Yi, Seoul (KR); Sang Myeong Han, Seoul (KR)

(73) Assignee: Industry-Academic Cooperation Foundation, Yonsei University, Seoul (KR)

( * ) Notice: Subject to any disclaimer, the term of this patent is extended or adjusted under 35 U.S.C. 154(b) by 656 days.

This patent is subject to a terminal disclaimer.

(21) Appl. No.: 17/971,741

(22) Filed: Oct. 24, 2022

(65) Prior Publication Data

US 2023/0132777 A1 May 4, 2023

(30) Foreign Application Priority Data

Oct. 25, 2021 (KR) ..... 10-2021-0142875
Sep. 29, 2022 (KR) ..... 10-2022-0124114

(51) Int. Cl.

| | |
|---|---|
| ***C25B 11/081*** | (2021.01) |
| ***B22F 1/054*** | (2022.01) |
| ***B22F 9/24*** | (2006.01) |
| ***C25B 1/04*** | (2021.01) |

(52) U.S. Cl.

CPC ..... *C25B 11/081* (2021.01); *B22F 1/054* (2022.01); *B22F 9/24* (2013.01); *C25B 1/04* (2013.01); *B22F 2301/255* (2013.01); *B22F 2304/05* (2013.01)

(58) Field of Classification Search

CPC ..... C25B 11/081; C25B 1/04; B22F 1/054; B22F 9/24; B22F 2301/255; B22F 2304/05; Y02E 60/36

See application file for complete search history.

(56) References Cited

U.S. PATENT DOCUMENTS

2020/0024295 A1* 1/2020 Muresan ..... B01J 37/08
2022/0055020 A1* 2/2022 Chen ..... B01J 2235/30

FOREIGN PATENT DOCUMENTS

KR 1020120107303 A 10/2012
KR 101759433 B1 7/2017
KR 1020200125098 A 11/2020
KR 1020200125505 A 11/2020
KR 1020210092753 A 7/2021
WO WO-2018164642 A1 * 9/2018 ..... B22F 9/24
WO WO-2020218871 A1 * 10/2020 ..... B22F 1/16

OTHER PUBLICATIONS

"Superatom-in Superatom [RhH@Ag24(SPhMe2)18]2-Nanocluster" by Yi et al., Angew. Chem. Int. Ed. 60, pp. 22293-22300 (2021—available online Jul. 28, 2021).*

Supplemental Information for "Superatom-in Superatom [RhH@Ag24(SPhMe2)18]2-Nanocluster" by Yi et al., Angew. Chem. Int. Ed. 60, pp. 22293-22300 (2021—available online Jul. 28, 2021).*

Machine Translation of WO-2020218871-A1.*

Chakrahari et al., "Synthesis of Bimetallic Copper-Rich Nanoclusters Encapsulating a Linear Palladium Dihydride Unit", Angewandte Chemie International Edition, 2019, pp. 4943-4947, vol. 58.

Yi et al., "Superatom-in-Superatom [RhH@Ag24(SPhMe2)18]2-Nanocluster", Angewandte Chemie International Edition, 2021, pp. 1-8.

* cited by examiner

*Primary Examiner* — Bryan D. Ripa

(74) *Attorney, Agent, or Firm* — The Webb Law Firm

(57) ABSTRACT

Provided is a silver nanocluster doped with a metal hydride, a manufacturing method thereof, and an electrochemical catalyst for hydrogen gas generation. The silver nanocluster doped with the metal hydride has utility as an electrochemical catalyst, has a very low production cost compared to a conventional platinum (Pt) catalyst, and exhibits an equivalent or higher hydrogen gas generation effect.

17 Claims, 7 Drawing Sheets

HIGH LUMINOUS SILVER NANOCLUSTERS DOPED WITH METAL HYDRIDE, MANUFACTURING METHOD THEREOF, AND ELECTROCHEMICAL CATALYST FOR HYDROGEN GAS GENERATION

CROSS-REFERENCE TO RELATED APPLICATIONS

This application claims priority to Korean Patent Application No. 10-2021-0142875 filed Oct. 25, 2021, and Korean Patent Application No. 10-2022-0124114 filed Sep. 29, 2022, the disclosures of which are hereby incorporated by reference in their entireties.

BACKGROUND OF THE INVENTION

Field of the Invention

The following disclosure relates to a highly luminous silver nanocluster doped with a metal hydride, a manufacturing method thereof, an electrochemical catalyst containing the same, and a device for hydrogen gas generation including the same.

Description of Related Art

A nanocluster or superatom composed of a specific number of metal atoms and ligands follows a superatomic orbital theory which states that a valence electron of a particle is newly defined as a single super atom.

A nanocluster is stable more than a single atom or a nanoparticle, and has stronger molecular properties than metallic properties, and thus has completely different optical and electrochemical properties from a nanoparticle. In particular, as optical, electrical, and catalytic properties of a nanocluster vary sensitively depending on the number of metal atoms, types of metal atoms, and ligands, research on the nanocluster has been actively conducted in a wide variety of fields.

On the other hand, as economic growth continues, fossil fuels are rapidly depleted, and as a countermeasure, interest in development of new renewable energy and high-performance catalysts for effective use thereof has rapidly increased. As such renewable energy, hydrogen gas has no regional ubiquity, has a high energy density (142 kJ/g), and has become prominent as a non-toxic, infinitely renewable energy source. A catalyst is required for such a hydrogen gas evolution reaction, and the catalyst for hydrogen gas generation is neither too strong nor too weak to bond with hydrogen. If a bonding force with hydrogen is too weak, a catalyst-hydrogen bonding for hydrogen gas generation may be difficult, and if a bonding force with hydrogen is too strong, hydrogen gas may not be separated from the catalyst after a hydrogen gas evolution reaction is completed.

Until now, platinum (Pt) is known as the most suitable catalyst material for a hydrogen evolution reaction (HER).

However, since platinum (Pt) is not only expensive but also has limited reserves, it has low economic efficiency and is a constraint that hinders commercialization, and thus it is required to develop a high-performance catalyst for a hydrogen evolution reaction that may replace platinum

RELATED ART DOCUMENT

Patent Document (Patent Document 1) Korean Patent Laid-open Publication No. 10-2012-0107303 (Oct. 2, 2012)

(Patent Document 2) Korean Patent No. 10-1759433 (Jul. 12, 2017)

SUMMARY OF THE INVENTION

An embodiment of the present invention is directed to providing a silver nanocluster doped with a metal hydride.

Another embodiment of the present invention is directed to providing a method for manufacturing the silver nanocluster doped with the metal hydride.

Yet another embodiment of the present invention is directed to providing an electrochemical catalyst containing the silver nanocluster doped with the metal hydride.

The present invention also provides a device for hydrogen gas generation including the electrochemical catalyst.

In one general aspect, there is provided a silver nanocluster doped with a metal hydride satisfying the following Formula 1:

$$[MH_XAg_{24}(SR)_{18}]^{2-} \quad \text{[Formula 1]}$$

wherein M is Ir, Ru, or Os;

X is an integer according to an oxidation value of M; and

SR is an organothiol-based ligand.

$MH_X$ in Formula 1 may be IrH, $RuH_2$, or $OsH_2$.

In addition, the organothiol-based ligand in Formula 1 may be C1-C30 alkanethiol, C1-C10 alkyl-substituted C1-C30 alkanethiol, C6-C30 arylthiol, or C1-C10 alkyl-substituted C6-C30 arylthiol; and preferably, the organothiol-based ligand may be C1-C4 alkyl-substituted C6-C12 arylthiol.

A luminous yield of the silver nanocluster doped with the metal hydride may be 100 times or more of the luminous yield of the silver nanocluster.

In another general aspect, a method for manufacturing a silver nanocluster doped with a metal hydride includes:

a) preparing a reaction solution by reacting a silver precursor with an organothiol-based ligand compound; and b) adding a metal hydride precursor and a reducing agent to the reaction solution to manufacture a nanocluster satisfying the following Formula 1:

$$[MH_XAg_{24}(SR)_{18}]^{2-} \quad \text{[Formula 1]}$$

wherein M is Ir, Ru, or Os;

X is an integer according to the oxidation value of M; and

SR is an organothiol-based ligand.

Performing precipitation and separation with an aromatic solvent, after step b), may be further included.

A molar ratio of the silver precursor:the metal hydride precursor may be 1:0.02 to 0.2, and preferably, the molar ratio may be 1:0.05 to 0.15.

The silver precursor may be any one or two or more selected from the group consisting of $AgNO_3$, $AgBF_4$, $AgCF_3SO_3$, $AgClO_4$, $AgO_2CCH_3$, and $AgPF_6$, and the metal hydride precursor may be a halogenated hydrate of Ir, Ru, or Os.

The reducing agent may be one or two or more selected from triethylamine, oleylamine, carbon monoxide, and sodium borohydride.

In another general aspect, there is provided an electrochemical catalyst containing a silver nanocluster doped with the metal hydride. The electrochemical catalyst may be an electrochemical catalyst for hydrogen gas generation, and the present invention provides a device for hydrogen gas generation including the same.

The device for hydrogen gas generation may include:

a power supply;

a working electrode and a counter electrode connected to the power supply; and an aqueous electrolyte in which the electrodes are impregnated, wherein the working electrode may be coated with the electrochemical catalyst as described above.

In another general aspect, there is provided a luminous body including the silver nanocluster doped with a metal hydride as described above.

DESCRIPTION OF THE INVENTION

Figure 1:
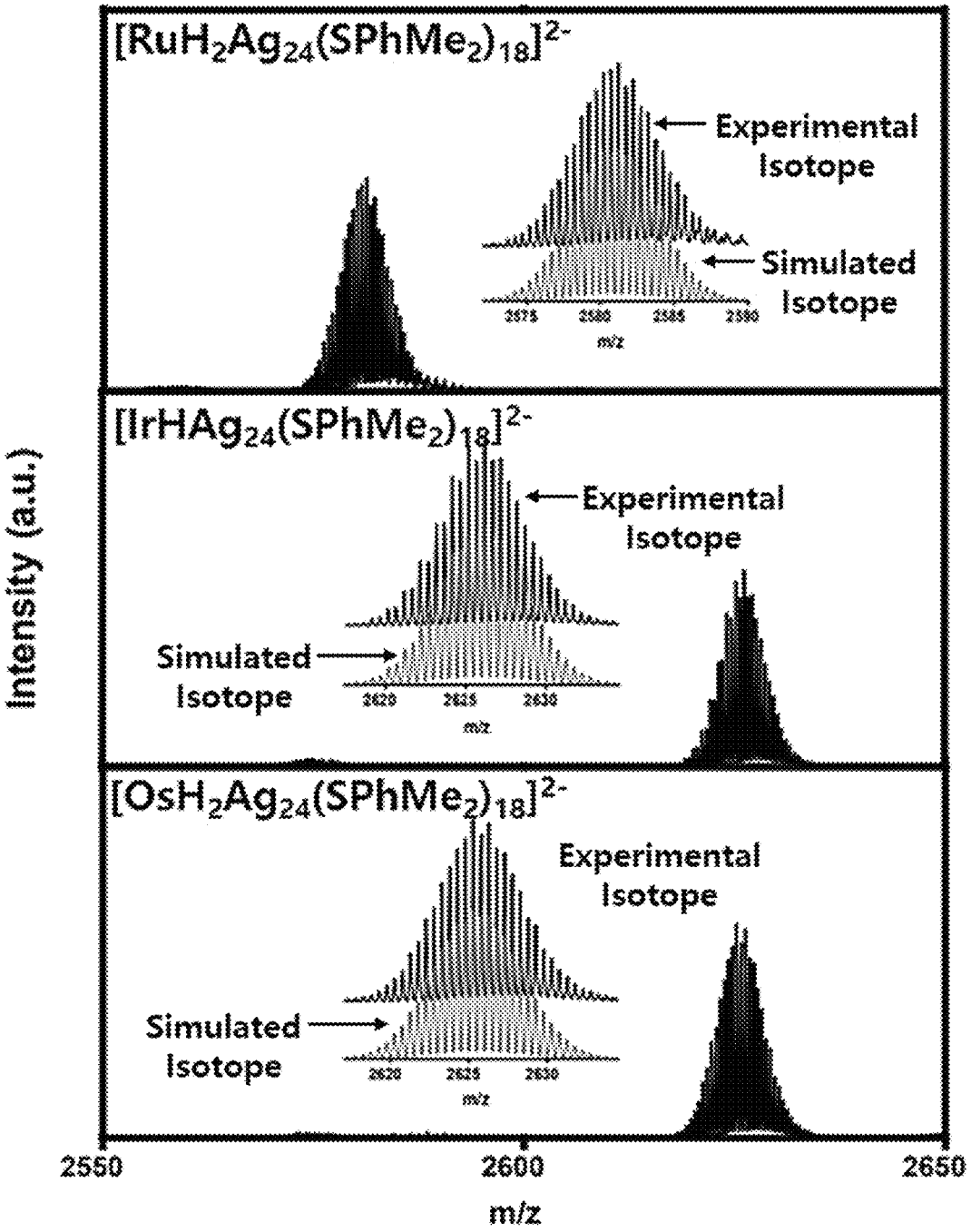
FIG. 1 is a diagram illustrating results of electrospray ionization mass spectrometry (ESI-MS) for Examples 1 TO 3.

Hereinafter, a silver nanocluster doped with a metal hydride according to the present invention, a manufacturing method thereof, an electrochemical catalyst containing the same, and a device for hydrogen gas generation including the same will be described in detail.

Technical terms and scientific terms used herein have the general meaning understood by those skilled in the art to which the present invention pertains, unless otherwise defined, and a description for the known function and configuration unnecessarily obscuring the gist of the present invention will be omitted in the following description.

Singular forms used herein are intended to include the plural forms as well unless otherwise indicated in context.

In addition, numerical ranges used herein include a lower limit, an upper limit, and all values within that range, increments that are logically derived from the type and width of the defined range, all double-defined values, and all possible combinations of upper and lower limits of numerical ranges defined in different forms. Unless otherwise defined herein, values outside the numerical range that may arise due to experimental errors or rounded values are also included in the defined numerical range.

As used herein, the term "comprise" is an "open" description having the meaning equivalent to expressions such as "include," "contain," "have," or "feature", and does not exclude elements, materials, or process that are not further listed.

Until now, platinum (Pt) has been known as the most suitable catalyst material for a hydrogen evolution reaction (HER), but it is not only expensive but also has limited reserves, so it has low economic efficiency and is a constraint that hinders commercialization.

Accordingly, as a result of intensifying research, the present inventors have found that when a silver nanocluster is doped with hydrides of iridium, ruthenium, and osmium metals, a nanocluster catalyst that is inexpensive compared to platinum and has excellent hydrogen gas evolution reactivity may be provided, and the present invention has been completed.

In detail, an exemplary embodiment of the present invention is a silver nanocluster doped with a metal hydride satisfying the following Formula 1, which may be inexpensive compared to platinum and may have excellent hydrogen gas evolution reactivity:

$$[MH_XAg_{24}(SR)_{18}]^{2-} \quad \text{[Formula 1]}$$

wherein M is Ir, Ru, or Os;

X is an integer according to the oxidation value of M; and

SR is an organothiol-based ligand.

In an exemplary embodiment, $MH_X$ in Formula 1 may be IrH, $RuH_2$, or $OsH_2$.

Specifically, the organothiol-based ligand in Formula 1 according to an exemplary embodiment of the present invention may be any one or two or more selected from the group consisting of C1-C30 alkanethiol, C6-C30 arylthiol, C3-C30 cycloalkanethiol, C5-C30 heteroarylthiol, C3-C30 heterocycloalkanethiol, and C6-C30 arylalkanethiol, etc., and in the organothiol-based ligand, one or more hydrogens in a functional group may be further substituted with a substituent or may not be substituted. Here, substituents are C1-C10 alkyl, halogen, nitro, cyano, hydroxy, amino, C6-C20 aryl, C2-7 alkenyl, C3-C20 cycloalkyl C3-C20 heterocycloalkyl, or C4-C20 heteroaryl, provided that the number of carbon atoms of the organothiol-based ligand described above does not include the number of carbon atoms of the substituent.

More specifically, in Formula 1, the organothiol-based ligand may be C1-C30 alkanethiol, C1-C10 alkyl-substituted C1-C30 alkanethiol, C6-C30 arylthiol, or C1-C10 alkyl-substituted C6-C30 arylthiol. As an example, the organothiol-based ligand may be any one or two or more selected from the group consisting of pentanethiol, hexanethiol, heptanethiol, and 2,4-dimethylbenzenethiol, but the present invention is not limited thereto.

Preferably, the organothiol-based ligand may be C1-C4 alkyl-substituted C6-C12 arylthiol, for example, 2,4-dimethylbenzenethiol.

The silver nanocluster doped with a metal hydride satisfying Formula 1 according to an exemplary embodiment of the present invention may exhibit a form in which $MH_XAg_{12}$ at the center has an icosahedral structure and is surrounded by six $Ag_2(SR)_3$.

In addition, the luminous yield of the silver nanocluster doped with a metal hydride according to the present invention may be 100 times or more of the luminous yield of the silver nanocluster, and may exhibit significantly improved luminous properties.

According to an exemplary embodiment, the silver nanocluster doped with IrH exhibits a maximum photoluminescence intensity at about 750 nm. The silver nanocluster doped with $OsH_2$ exhibits the maximum photoluminescence intensity at about 700 nm, and the silver nanocluster doped with $RuH_2$ exhibits the maximum photoluminescence intensity at about 755 nm. Preferably, the silver nanocluster doped with IrH exhibits the strongest photoluminescence intensity, and may exhibit significantly excellent photoluminescence intensity compared to the nanoparticle containing the same mass of Ir.

A method for manufacturing a silver nanocluster doped with a metal hydride according to an exemplary embodiment of the present invention may include:

a) preparing a reaction solution by reacting a silver precursor with an organothiol-based ligand compound; and b) adding a metal hydride precursor and a reducing agent to the reaction solution to manufacture a nanocluster satisfying the following Formula 1:

$$[MH_XAg_{24}(SR)_{18}]^{2-} \quad \text{[Formula 1]}$$

wherein M is Ir, Ru, or Os;

X is an integer according to the oxidation value of M; and

SR is an organothiol-based ligand.

By manufacturing the nanocluster for hydrogen gas generation satisfying Formula 1 through such a method, it is possible to manufacture the silver nanocluster for hydrogen gas generation that is inexpensive compared to platinum and have excellent activity for the hydrogen gas evolution reaction.

In an exemplary embodiment, performing precipitation and separation with an aromatic solvent, after step b), may be further included, and specifically, the aromatic solvent may be one or two or more selected from nitrobenzene, benzene, xylene, chlorobenzene, and toluene. In more detail, the aromatic solvent may be toluene, but the present invention is not limited thereto.

The method for manufacturing a silver nanocluster doped with a metal hydride according to an exemplary embodiment of the present invention is very advantageous when used industrially because it may be synthesized relatively quickly without a long aging process, unlike a conventional method for manufacturing the silver nanocluster or a silver nanocluster doped with dissimilar metals.

In addition, the method for manufacturing a silver nanocluster doped with a metal hydride according to an exemplary embodiment of the present invention adopts precipitation and separation methods using an aromatic solvent, so that it may be completely separated without the need to perform the conventional aging process for convergence, unlike a conventional manufacturing method of a silver nanocluster doped with dissimilar metals. Thus, a high-purity product may be obtained by an industrially easy method.

In an exemplary embodiment, a molar ratio of the silver precursor:the metal hydride precursor may be 1:0.02 to 0.2, and preferably, the molar ratio may be 1:0.05 to 0.15. In such a range, the silver nanocluster doped with a metal hydride may be synthesized in high yield.

In an exemplary embodiment, the silver precursor may be any one or two or more selected from the group consisting of $AgNO_3$, $AgBF_4$, $AgCF_3SO_3$, $AgClO_4$, $AgO_2CCH_3$, and $AgPF_6$, and preferably, synthesis efficiency may be greatly improved using $AgNO_3$.

In an exemplary embodiment, the metal hydride precursor may be a halogenated hydrate of Ir, Ru, or Os, for example, $IrBr_3 \cdot xH_2O$, $IrCl_3 \cdot xH_2O$, $RuBr_3 \cdot xH_2O$, $RuCl_3 \cdot xH_2O$, $RuI_3 \cdot xH_2O$, or $OsCl_3 \cdot 3H_2O$, but is not limited thereto.

Also, in an exemplary embodiment, the organothiol-based ligand compound may be used as long as it is a compound that may be used as an organothiol-based ligand represented by SR of Formula 1 as described above, and may be RSH, which is a compound before hydrogen is reduced when compared to SR. As a specific example, the organothiol-based ligand compound may be pentanethiol, hexanethiol, heptanethiol, or 2,4-dimethylbenzenethiol, and more specifically 2,4-dimethylbenzenethiol.

In an exemplary embodiment of the present invention, a mixing ratio of the silver precursor and the organothiol-based ligand compound may be a mixing ratio conventionally in the art, specifically 1:1 to 10, more specifically 1:2 to 5, and more preferably 1:2.5 to 3.5. In such a range, it is possible to reduce impurities in the reaction while having excellent yield than during manufacture.

In an exemplary embodiment of the present invention, the reaction solution of step a) may further include a solvent to improve the dissolution and reaction ease of the metal precursor, and the solvent may be used without particular limitation as long as it is commonly used in the art. As a specific example, the solvent may be a polar solvent, specifically, any one or two or more selected from water, C1-C5 alcohol, acetonitrile, dimethyl sulfoxide (DMSO), dimethylformamide (DMF), acetone, tetrahydrofuran (THF) and 1,4-dioxane, and may preferably be tetrahydrofuran (THF), but the present invention is not limited thereto.

In addition, in an exemplary embodiment, adding a ligand to form a complex with a silver nanocluster doped with a metal hydride, after step a), may be further included. The ligand may be a ligand having a charge opposite to that of the silver nanocluster doped with a metal hydride, for example, tetraphenylphosphonium bromide ($PPh_4^+$) or tetraoctylammonium bromide ($Oct_4N^+$), but the present invention is not limited thereto.

In an exemplary embodiment, the reducing agent may be used without particular limitation as long as it is commonly used in the art, and may be one or two or more selected from triethylamine, oleylamine, carbon monoxide, and sodium borohydride, preferably sodium borohydride, but the present invention is not limited thereto.

In addition, after completion of the reaction in step b), an additional purification process may be further performed to obtain high-purity silver nanoclusters, which may be performed through a conventional method.

In addition, the present invention provides an electrochemical catalyst containing a silver nanocluster doped with a metal hydride.

The electrochemical catalyst according to an exemplary embodiment may be an electrochemical catalyst for hydrogen gas generation used in the following scheme:

$$2H^+(aq) \rightarrow H_2(g) \quad \text{[Scheme]}$$

Since the electrochemical catalyst for hydrogen gas generation according to an exemplary embodiment of the present invention causes an electrochemical catalytic reaction from hydrogen ions ($2H^+$) to hydrogen gas ($H_2$) in an aqueous solution with high efficiency, it may be economically and easily utilized for a hydrogen evolution reaction.

More preferably, the electrochemical catalyst containing a silver nanocluster doped with a metal hydride satisfying Formula 1 according to an exemplary embodiment of the present invention may secure a high-performance hydrogen gas generation reactivity that is almost similar to that of a platinum catalyst in an alkaline solution.

The present invention provides a method for hydrogen gas generation using an electrochemical catalyst containing a silver nanocluster doped with metal hydride according to an exemplary embodiment. Specifically, the method for hydrogen gas generation may include: generating hydrogen gas on a surface of a working electrode by applying an electric current in a reaction tank including a power supply, a working electrode and a counter electrode to which the electrochemical catalyst is applied connected to the power supply, and an aqueous electrolyte in which the electrodes are impregnated, and collecting the generated hydrogen gas.

The present invention provides a device for hydrogen gas generation containing the electrochemical catalyst.

The device for hydrogen gas generation according to an exemplary embodiment of the present invention includes:

a power supply;

a working electrode and a counter electrode connected to the power supply; and an aqueous electrolyte in which the electrodes are impregnated;

wherein the working electrode may be coated with the electrochemical catalyst as described above.

In an exemplary embodiment, the electrode coated with the electrochemical catalyst may include a conductive material and a polymer binder. In the use of the conductive material, a weight ratio of the electrochemical catalyst:the conductive material may be 1:0.5 to 2, preferably 1:0.8 to 1.2. Also, when the weight ratio of the electrochemical catalyst:the conductive material satisfies the above range, since the electrochemical catalyst for hydrogen gas generation may cover a surface of the conductive material with a single layer, the cost may be reduced by using a minimum amount of catalyst and at the same time, a maximum catalyst efficiency may be exhibited, which is preferable.

In an exemplary embodiment of the present invention, the conductive material may be a carbon material, but as long as it is commonly used in the art, it may be used without particular limitation. A specific example of a carbon body may be any one or two or more selected from the group consisting of carbon black, super-p, activated carbon, hard carbon, and soft carbon, but the present invention is not limited thereto.

In addition, the polymer binder is used for firmly fixing the electrochemical catalyst and the conductive material for generating hydrogen gas, and may be used without particular limitation as long as it is commonly used in the art, and specifically, for example, Nafion, etc., may be used. The amount of the polymer binder added is not particularly limited as long as the electrochemical catalyst and the conductive material for hydrogen gas generation are firmly fixed. As a specific example, the weight ratio of the electrochemical catalyst:the polymer binder may be 1:5 to 30, and preferably 1:10 to 20, but the present invention is not limited thereto.

The present invention provides a luminous body containing a silver nanocluster doped with metal hydride according to an exemplary embodiment. The luminous body containing a silver nanocluster doped with a metal hydride according to the present invention exhibiting luminous properties, may be applied to various fields such as display, bioimaging, and sensing, and has little toxicity unlike the existing toxic cadmium-based quantum dot particles and does not cause environmental problems, and thus may be very usefully applied. In addition, the silver nanocluster doped with a metal hydride according to the present invention exhibit an improved emission quantum yield of 100 times or more than that of the parent silver nanoclusters and the luminous body containing the same may exhibit excellent luminous quantum yield.

Hereinafter, the silver nanocluster doped with a metal hydride according to the present invention, a manufacturing method thereof, an electrochemical catalyst containing the same, and a device for hydrogen gas generation containing the same will be described in more detail through the following Examples. The following Examples are only a reference for describing the present invention in detail, and the present invention is not limited thereto and may be implemented in various forms.

EXAMPLE 1

Preparation of $[IrHAg_{24}(SPhMe_2)_{18}]^{2-}$

At room temperature, 40.0 mg of $AgNO_3$ (0.23 mmol) (>99.9%, Alfa Aesar) was dissolved in 2 mL of water, 15 mL of tetrahydrofuran (THF) was added thereto, and the mixture was stirred vigorously for 2 minutes. To the reaction solution, 0.090 mL of 2,4-dimethylbenzenethiol (0.65 mmol) (>96%, Tokyo Chemical Industry) was added.

To the reaction solution, 12 mg of tetraphosphonium bromide (0.028 mmol) (97%, Merck) dissolved in 1 mL of methanol was added, and 7 mg of $IrCl_3 \cdot xH_2O$ (0.024 mmol) (99.8%, Alfa Aesar) was added. Then, 15 mg of $NaBH_4$ (0.4 mmol) dissolved in 0.5 mL of ice-cold water was added, and a reduction reaction was performed by stirring for 3 hours, and then concentrated under reduced pressure and dried.

After the dried product was dissolved in 4 mL of methylene chloride, reaction by-products were precipitated with 8 mL of methanol, and 16 mL of methanol was added to the supernatant, followed by centrifugation. The obtained precipitate was a silver nanocluster doped with $Ag_{25}$ and IrH, and was separated by precipitation using toluene to obtain $(PPh_4^+)_2[IrHAg_{24}(SPhMe_2)_{18}]^{2-}$.

EXAMPLE 2

Preparation of $[RuH_2Ag_{24}(SPhMe_2)_{18}]^{2-}$ $(PPh_4^+)_2[RuH_2Ag_{24}(SPhMe_2)_{18}]^{2-}$ was obtained in the same manner as in Example 1, except that 5 mg of $RuCl_3.xH_2O$ (0.021 mmol) (99.9%, Alfa Aesar) was used instead of 7 mg of $IrCl_3 \cdot xH_2O$ (0.024 mmol) (99.8%, Alfa Aesar) and the reduction reaction was performed for 15 minutes.

EXAMPLE 3

Preparation of $[OsH_2Ag_{24}(SPhMe_2)_{18}]^{2-}$ $(PPh_4^+)_2[OsH_2Ag_{24}(SPhMe_2)_{18}]^{2-}$ was obtained in the same manner as in Example 1, except that 7 mg of $OsCl_3 \cdot 3H_2O$ (0.024 mmol) (99.99%, Alfa Aesar) was used instead of 7 mg of $IrCl_3 \cdot xH_2O$ (0.024 mmol) (99.8%, Alfa Aesar).

COMPARATIVE EXAMPLE 1

Preparation of $[Ag_{25}(SPhMe_2)_{18}]^{1-}$ 40.0 mg of $AgNO_3$ (0.23 mmol) (>99.9%, Alfa Aesar) was dissolved in 2 mL of methanol, and then 15 mL of tetrahydrofuran (THF) was added and stirred. 0.090 mL of 2,4-dimethylbenzenethiol (0.65 mmol) (>96%, Tokyo Chemical Industry) was added to the reaction solution and stirred under an ice bath for 20 minutes.

To the reaction solution, 6 mg of tetraphosphonium bromide (0.014 mmol) (97%, Merck) dissolved in 1 mL of methanol was added, and 15 mg of $NaBH_4$ (0.4 mmol) dissolved in 0.5 mL of ice-cold water was added. The mixture was subjected to a reduction reaction by stirring for 3 hours, aged for 12 hours, and then centrifuged to obtain a precipitate, and washed with methylene chloride and methanol, respectively, to remove impurities. 3 mg of the obtained product was dissolved in 0.5 mL of methylene chloride, and then recrystallized by adding 5 mL of n-hexane to obtain $[Ag_{25}(SPhMe_2)_{18}]^{1-}$.

COMPARATIVE EXAMPLE 2

Preparation of $[PdAg_{24}(SPhMe_2)_{18}]^{2-}$ 40.0 mg of $AgNO_3$ (0.23 mmol) (>99.9%, Alfa Aesar) was dissolved in 2 mL of methanol, and then 15 mL of tetrahydrofuran (THF) was added and stirred. 0.090 mL of 2,4-dimethylbenzenethiol (0.65 mmol) (>96%, Tokyo Chemical Industry) was added to the reaction solution and stirred under an ice bath for 20 minutes.

To the reaction solution, 12 mg of tetraphosphonium bromide (0.028 mmol) (97%, Merck) and 4 mg of $Na_2PdCl_4$ (0.01 mmol) (98%, Merck) dissolved in 1 mL of methanol were added, and 15 mg of $NaBH_4$ (0.4 mmol) dissolved in 0.5 mL of ice-cold water was added. The mixture was subjected to a reduction reaction by stirring for 6 hours, aged for 12 hours, and then centrifuged to obtain a precipitate, washed with methylene chloride and methanol, respectively, to remove impurities. 3 mg of the obtained product was dissolved in 0.5 mL of methylene chloride, and then recrystallized by adding 5 mL of n-hexane to obtain $[PdAg_{24}(SPhMe_2)_{18}]^{2-}$.

COMPARATIVE EXAMPLE 3

Preparation of $[PtAg_{24}(SPhMe_2)_{18}]^{2-}$ $[PtAg_{24}(SPhMe_2)_{18}]^{2-}$ was obtained in the same manner as in Comparative Example 2, except that 4 mg of $Na_2PtCl_4 \cdot xH_2O$ (0.01 mmol) (Merck) was used instead of 4 mg of $Na_2PdCl_4$ (0.01 mmol) (98%, Merck).

EXPERIMENTAL EXAMPLE 1

Synthesis Confirmation

As illustrated in FIG. 1, it was confirmed that the silver nanoclusters of Examples 1 to 3 were synthesized as a single material through electrospray ionization mass spectrometry (ESI-MS).

Figure 2:
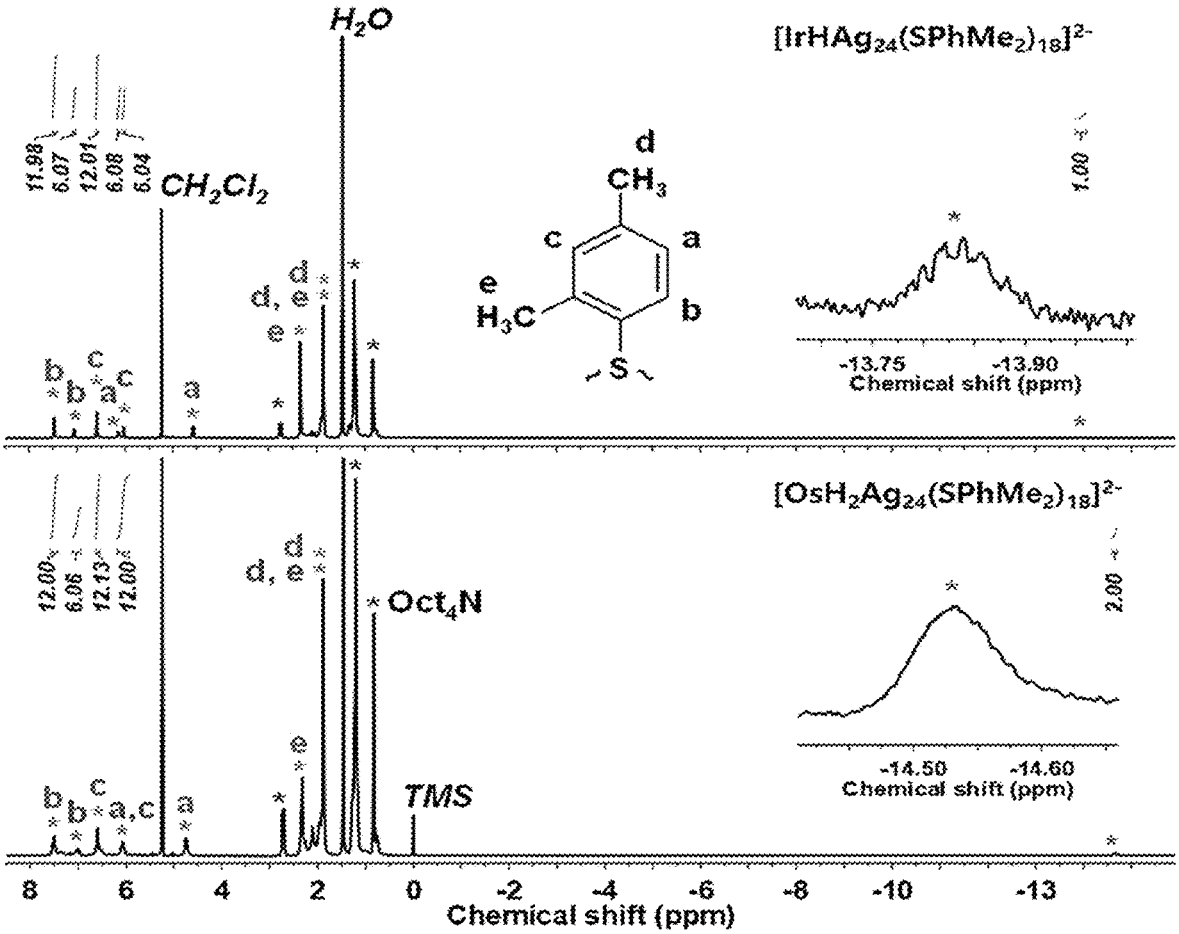
FIG. 2 is a diagram illustrating results of 1H-NMR spectrum analysis for Examples 1 and 3.

As illustrated in FIG. 2, in order to more clearly analyze $^1$H-NMR spectrum, $^1$H-NMR spectrum analysis of silver nanoclusters in which a complex was formed with $Oct_4N^+$ instead of $PPh_4^+$ of Examples 1 and 3 was performed. From FIG. 2, it was confirmed that hydrogen atoms of the silver nanoclusters of Examples 1 and 3 were co-doped with a metal into an $Ag_{24}(SPhMe_2)_{18}$ framework.

EXPERIMENTAL EXAMPLE 2

Analysis of Electrochemical Properties

Figure 3:
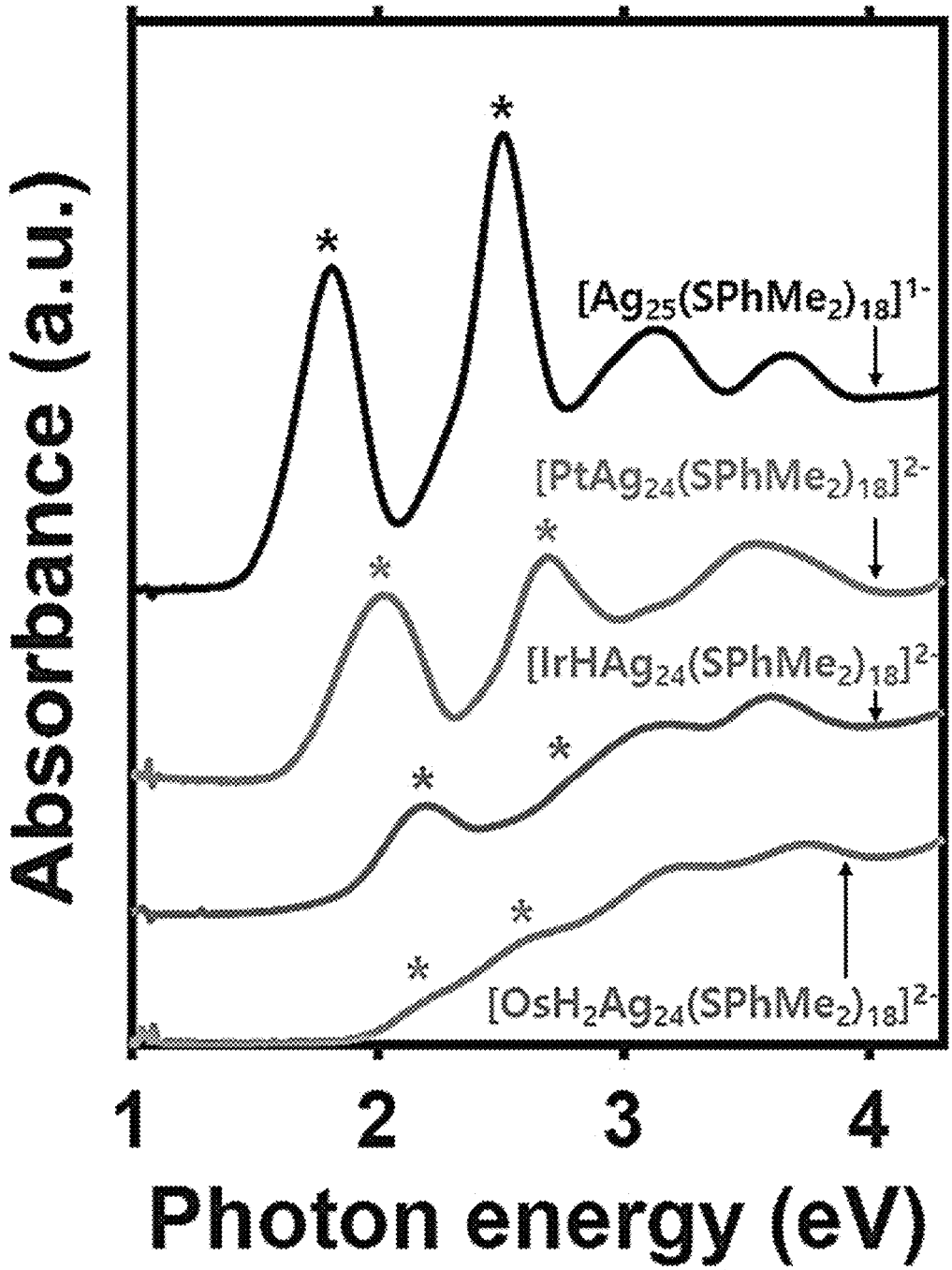
FIG. 3 is a diagram illustrating results of UV-visible light (UV-Vis) spectrum analysis for Example 1, Example 3, Comparative Examples 1, and Comparative Example 3.

As illustrated in FIG. 3, it was confirmed that an electronic structure was sensitively changed depending on a type of doped metal and metal hydride through ultraviolet-visible light (UV-Vis) spectral analysis of Examples 1, Example 3, Comparative Example 1, and Comparative Example 3.

Figure 4:
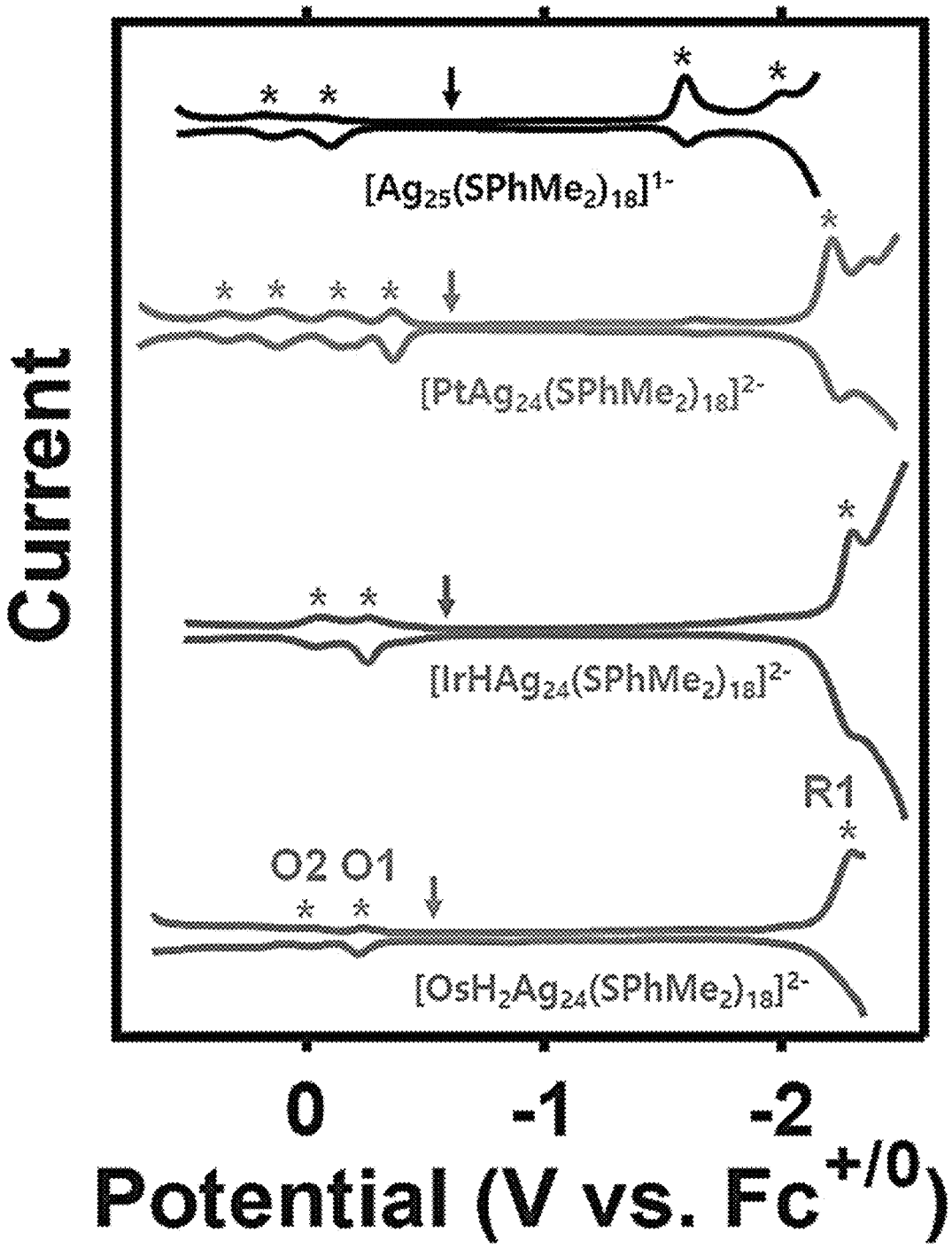
FIG. 4 is a diagram illustrating results of square wave voltammogram (SWV) analysis for Example 1, Example 3, Comparative Example 1, and Comparative Example 3.

In addition, as illustrated in FIG. 4, it was confirmed that a HOMO-LUMO gap was consistent with the predicted value by DFT calculation through the square wave voltammogram analysis of Example 1, Example 3, Comparative Example 1, and Comparative Example 3.

Figure 5:
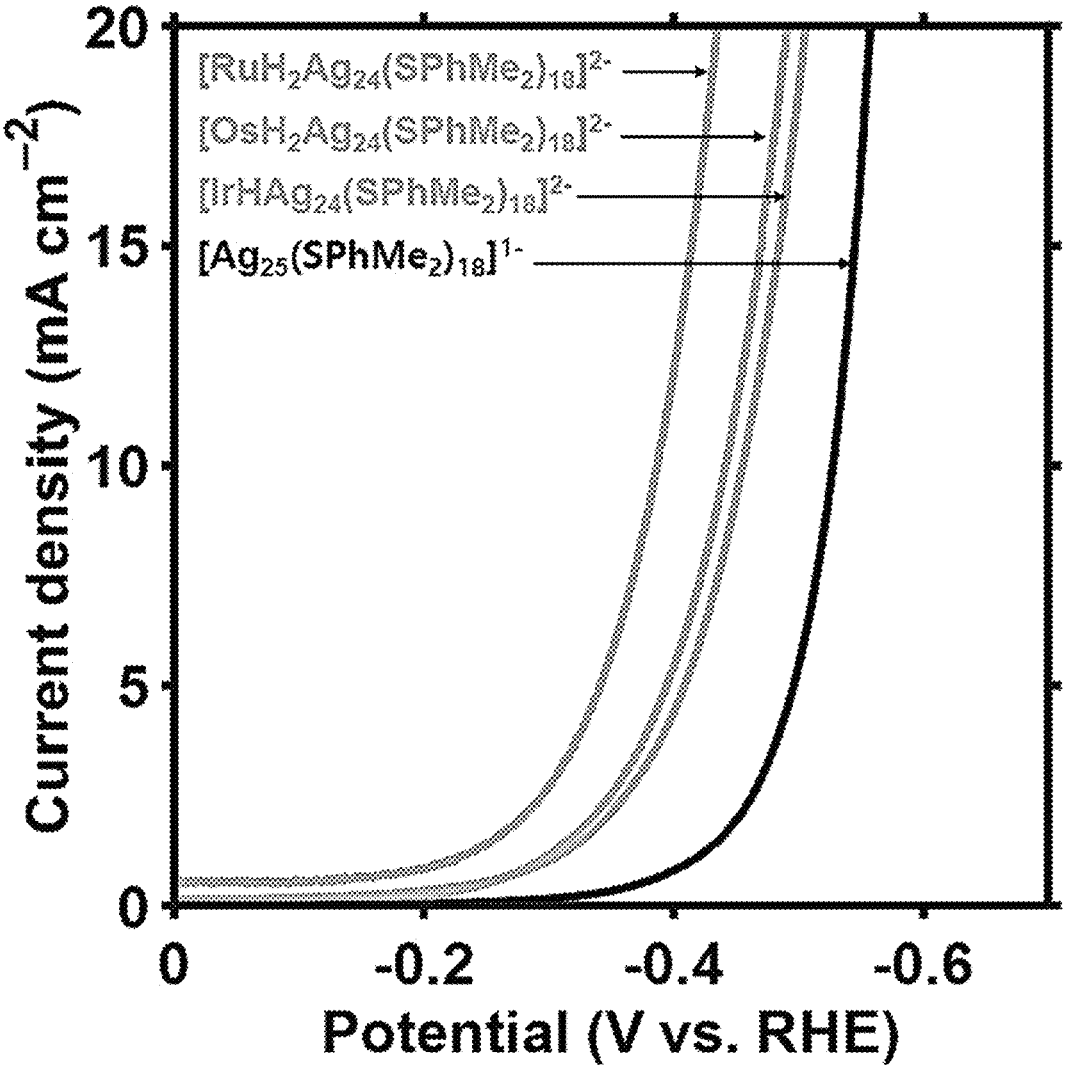
FIG. 5 is a diagram illustrating a graph measuring hydrogen evolution reaction (HER) performance of Examples 1 to 3 and Comparative Example 1.

FIG. 5 illustrates a graph measuring the HER (Hydrogen Evolution Reaction) performance of Examples 1 to 3 and Comparative Example 1. As illustrated in FIG. 5, it was confirmed that an onset potential of the Example was closer to a theoretical value than a value of Comparative Example 1. Based on these results, it was found that the silver nanoclusters doped with a metal hydride according to an exemplary embodiment of the present invention have an excellent hydrogen gas generation effect.

Figure 6:
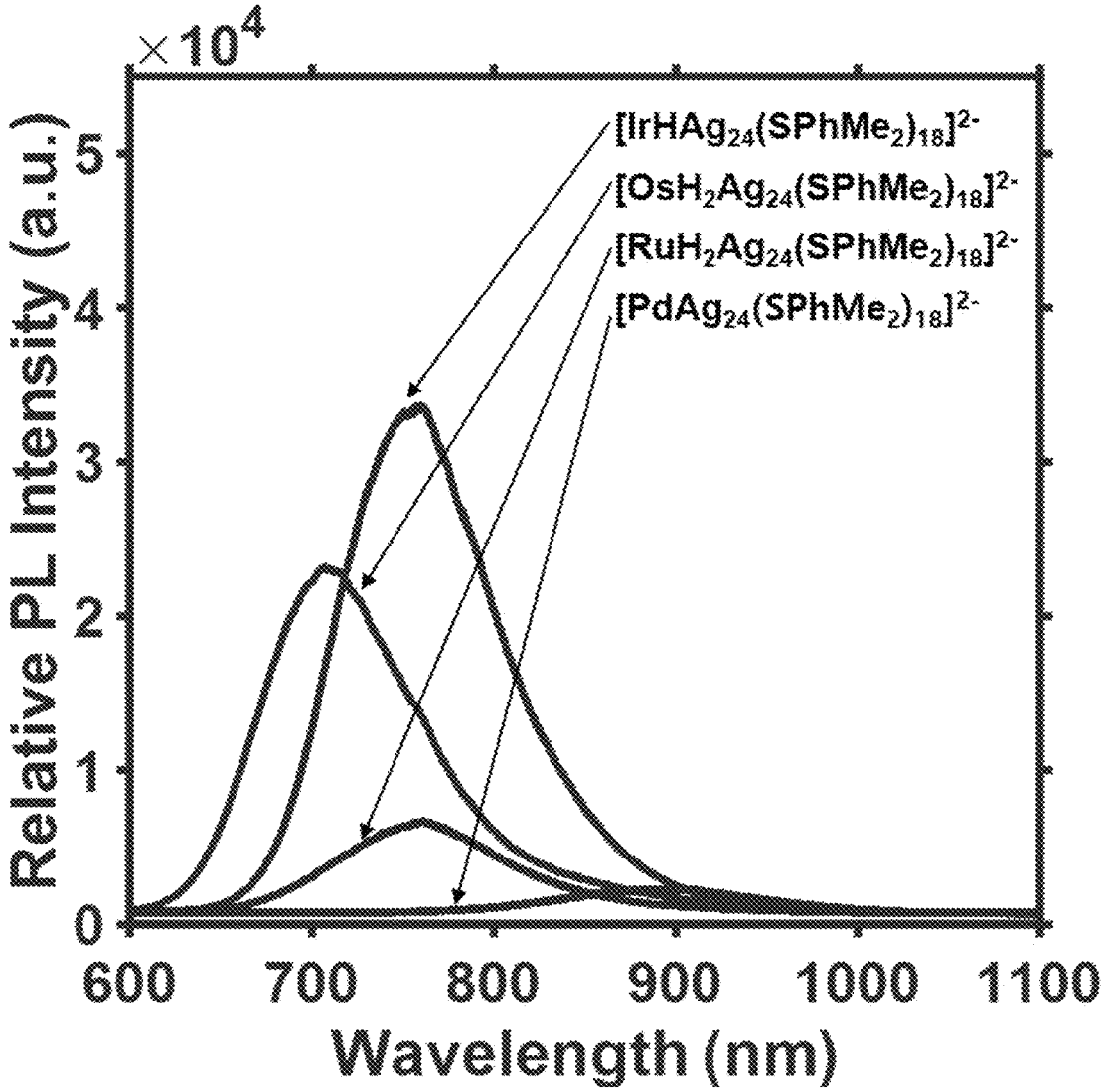
FIG. 6 is a diagram illustrating photoluminescence spectra of Examples 1 to 3 and Comparative Example 2.

FIG. 6 illustrates photoluminescence emission spectra of Examples 1 to 3 and Comparative Example 2. As illustrated in FIG. 6, it can be seen that the photoluminescence intensity of Examples 1 to 3 was greatly improved compared to Comparative Example 2.

Figure 7:
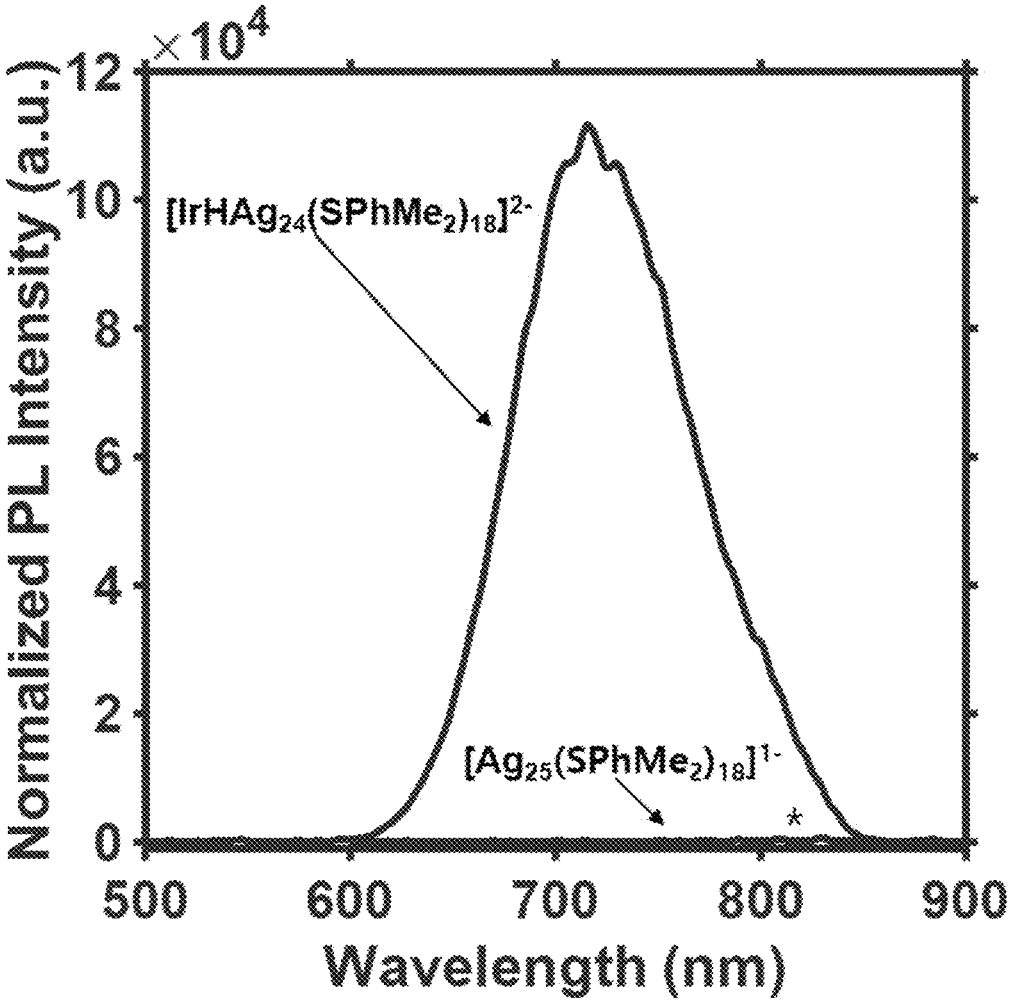
FIG. 7 is a diagram illustrating photoluminescence spectra of Example 1 and Comparative Example 1.

In addition, FIG. 7 illustrates the photoluminescence emission spectra of Example 1 and Comparative Example 1. As illustrated in FIG. 7, it can be seen that the photoluminescence intensity of Example 1 is significantly improved compared to Comparative Example 1, and in particular, the luminous yield of Example 1 was 20.6%, which is 100 times or more increased compared to the light emission yield of 0.2% of Comparative Example 1.

Accordingly, it can be seen that the silver nanocluster doped with a metal hydride according to the present invention exhibits a significantly improved photoluminescence performance, and an electrochemical catalyst employing the same because of excellent hydrogen generation performance and a device for hydrogen gas generation including the same may exhibit excellent hydrogen generation effect and electrochemical performance.

The electrochemical catalyst employing a silver nanocluster doped with a metal hydride according to the present invention is a catalyst doped with iridium hydride, ruthenium hydride, and osmium hydride, has a very low production cost compared to the conventional platinum (Pt)-doped catalyst, and may achieve an equivalent or higher hydrogen gas generation effect.

In addition, the method of manufacturing the silver nanocluster doped with the metal hydride according to an exemplary embodiment of the present invention is simple and easy to mass-produce under a mild condition.

By using the device for generating hydrogen gas including the electrochemical catalyst according to an embodiment of the present invention, the silver nanocluster doped with the metal hydride according to an exemplary embodiment of the present invention may have greatly improved hydrogen gas evolution reaction activity.

The silver nanocluster doped with a metal hydride according to an exemplary embodiment of the present invention may exhibit excellent luminous properties, and may exhibit a significantly improved luminous yield.

Hereinabove, although the present invention has been described by specific matters and the limited embodiments, they have been provided only for assisting in a more general understanding of the present invention. Therefore, the present invention is not limited to the exemplary embodiments. Various modifications and changes may be made by those skilled in the art to which the present invention pertains from this description.

Therefore, the spirit of the present invention should not be limited to the above-mentioned embodiments, but the claims and all of the modifications equal or equivalent to the claims are intended to fall within the scope and spirit of the present invention.

What is claimed is:

1. A silver nanocluster doped with a metal hydride satisfying the following Formula 1:

$$[MH_XAg_{24}(SR)_{18}]^{2-} \quad \text{[Formula 1]}$$

wherein M is Ir, Ru, or Os;

X is an integer according to the oxidation value of M; and

SR is an organothiol-based ligand.

2. The silver nanocluster of claim 1, wherein $MH_X$ in Formula 1 is IrH, $RuH_2$, or $OsH_2$.

3. The silver nanocluster of claim 1, wherein the organothiol-based ligand in Formula 1 is C1-C30 alkanethiol, C1-C10 alkyl-substituted C1-C30 alkanethiol, C6-C30 arylthiol, or C1-C10 alkyl-substituted C6-C30 arylthiol.

4. The silver nanocluster of claim 3, wherein the organothiol-based ligand is C1-C4 alkyl-substituted C6-C12 arylthiol.

5. The silver nanocluster of claim 1, wherein a luminous yield of the silver nanocluster doped with the metal hydride is 100 times or more of the luminous yield of the silver nanocluster not doped with the metal hydride.

6. A method for manufacturing a silver nanocluster doped with a metal hydride comprising:

a) preparing a reaction solution by reacting a silver precursor with an organothiol-based ligand compound; and b) adding a metal hydride precursor and a reducing agent to the reaction solution to manufacture a nanocluster satisfying the following Formula 1:

$$[MH_XAg_{24}(SR)_{18}]^{2-} \quad \text{[Formula 1]}$$

wherein M is Ir, Ru, or Os;

X is an integer according to an oxidation value of M; and

SR is an organothiol-based ligand.

7. The method of claim 6, further comprising performing precipitation and separation with an aromatic solvent, after step b).

8. The method of claim 6, wherein a molar ratio of the silver precursor: the metal hydride precursor is 1:0.02 to 0.2.

9. The method of claim 8, wherein the molar ratio of the silver precursor: the metal hydride precursor is 1:0.05 to 0.15.

10. The method of claim 6, wherein the silver precursor is any one or two or more selected from the group consisting of $AgNO_3$, $AgBF_4$, $AgCF_3SO_3$, $AgClO_4$, $AgO_2CCH_3$, and $AgPF_6$.

11. The method of claim 6, wherein the metal hydride precursor is a halogenated hydrate of Ir, Ru, or Os.

12. The method of claim 6, wherein the reducing agent is one or two or more selected from triethylamine, oleylamine, carbon monoxide, and sodium borohydride.

13. An electrochemical catalyst comprising the silver nanocluster doped with a metal hydride of claim 1.

14. The electrochemical catalyst of claim 13, wherein the electrochemical catalyst is an electrochemical catalyst for hydrogen gas generation.

15. A device for hydrogen gas generation comprising the electrochemical catalyst of claim 13.

16. The device for hydrogen gas generation of claim 15, wherein the device for hydrogen gas generation includes:

a power supply;

a working electrode and a counter electrode connected to the power supply; and an aqueous electrolyte in which the electrodes are impregnated, wherein the working electrode is coated with the electrochemical catalyst.

17. A luminous body comprising the silver nanocluster doped with a metal hydride of claim 1.

* * * * *